US008733104B2

(12) United States Patent
Kumar et al.

(10) Patent No.: US 8,733,104 B2
(45) Date of Patent: May 27, 2014

(54) SINGLE LOOP ATTEMPERATION CONTROL

(75) Inventors: Rajeeva Kumar, Clifton Park, NY (US); Karl Dean Minto, Ballston Lake, NY (US); William Forrester Seely, Taylors, SC (US); William George Carberg, Saratoga Springs, NY (US); Peter Paul Polukort, Berne, NY (US)

(73) Assignee: General Electric Company, Niskayuna, NY (US)

( * ) Notice: Subject to any disclaimer, the term of this patent is extended or adjusted under 35 U.S.C. 154(b) by 567 days.

(21) Appl. No.: 12/408,741

(22) Filed: Mar. 23, 2009

(65) Prior Publication Data

US 2010/0236241 A1 Sep. 23, 2010

(51) Int. Cl.
*F01K 7/34* (2006.01)
*F02C 6/00* (2006.01)

(52) U.S. Cl.
USPC ..... 60/653; 60/39.182; 60/679

(58) Field of Classification Search
USPC ..... 60/646, 653, 657, 677–679, 39.182
See application file for complete search history.

(56) References Cited

U.S. PATENT DOCUMENTS 2,830,440 A * 4/1958 Durham ..... 60/653
3,882,680 A * 5/1975 Durrant et al. ..... 60/646
4,208,882 A * 6/1980 Lopes et al. ..... 60/653

(Continued)

FOREIGN PATENT DOCUMENTS

CN 101338892 A 1/2009
CN 101368723 A 2/2009

(Continued)

OTHER PUBLICATIONS

V. Ganapathy; "Understand Steam Generator Performance" Energy Transfer/Conversion; Dec. 1994; Chemical Engineering Progress; Downloaded from the internet<http://v_ganapathy.tripod.com/stgenperf.pdf>; pp. 42-48.

(Continued)

*Primary Examiner* — Hoang M Nguyen
(74) *Attorney, Agent, or Firm* — Jason K. Klindtworth

(57) ABSTRACT

A heat recovery steam generation system is provided. The heat recovery steam generation system includes at least one superheater in a steam path for receiving a steam flow and configured to produce a superheated steam flow. The system also includes an inter-stage attemperator for injecting an attemperation fluid into the steam path. The system further includes a control valve coupled to the inter-stage attemperator. The control valve is configured to control flow of attemperation fluid to the inter stage attemperator. The system also includes a controller coupled to the control valve and the inter-stage attemperator. The controller further includes a feedforward controller and a trimming feedback controller. The feedforward controller is configured to determine a desired amount of flow of the attemperation fluid and the trimming feedback controller is configured to compensate for inaccuracies in the determined amount of flow of the attemperation fluid to determine a net desired amount of flow of attemperation fluid through the control valve into an inlet of the inter-stage attemperator based upon an outlet temperature of steam from the superheater. The controller also determines a control valve demand based upon the flow to valve characteristics. The controller further manipulates the control valve of the inter-stage attemperator, and injects the desired amount of attemperation flow via the inter-stage attemperator to perform attemperation upstream of an inlet into the superheater.

20 Claims, 4 Drawing Sheets

(56) References Cited

U.S. PATENT DOCUMENTS

| | | | | |
|---|---|---|---|---|
| 4,549,503 | A | 10/1985 | Keyes, IV et al. | |
| 4,555,906 | A * | 12/1985 | Martens et al. | 60/660 |
| 4,578,944 | A | 4/1986 | Martens et al. | |
| 4,887,431 | A | 12/1989 | Peet | |
| RE36,524 | E | 1/2000 | Tomlinson | |
| 6,301,895 | B1 | 10/2001 | Kallina et al. | |
| 6,422,022 | B2 | 7/2002 | Gorman et al. | |
| 7,793,501 | B2 * | 9/2010 | Narayanaswamy et al. | 60/653 |
| 8,104,283 | B2 | 1/2012 | Xu et al. | |
| 2005/0274113 | A1 * | 12/2005 | Sekiai et al. | 60/660 |

FOREIGN PATENT DOCUMENTS

| | | | |
|---|---|---|---|
| DE | 19749452 | A1 | 5/1999 |
| GB | 2449998 | A | 12/2008 |
| JP | 54047006 | A | 4/1979 |
| JP | 57139203 | A | 8/1982 |
| JP | 0245313 | U1 | 3/1990 |
| JP | 2008164264 | A | 7/2008 |

OTHER PUBLICATIONS

"Powerful Tool Integrates Technical and Financial Decision Making"; SOAPP-CT Version 8.0 Released; Downloaded from the internet:< http://soapp.epri.com/press/releases/Press_CTv80.pdf>; 9 Pages.

"CCI DRAGDA-90DSV Attemperator"; Downloaded from the internet<http://www.ccivalve.com/pdf/880.pdf>: 8 Pages.

Extended Search Report from corresponding EP Application No. 10156548.9-2321 dated Nov. 14, 2011.

Unofficial English translation of Office Action from CN dated Jun. 14, 2013.

Unofficial English translation of Office Action issued in connection with corresponding JP Application No. 2010-063518 on Jan. 21, 2014.

* cited by examiner

SINGLE LOOP ATTEMPERATION CONTROL

BACKGROUND

The present invention relates generally to control systems for controlling temperatures. More specifically, the invention relates to a temperature control of steam in relation to inter-stage attemperation, which may be used in heat recovery steam generation (HRSG) systems in combined cycle power generation applications.

HRSG systems may produce steam with very high outlet temperatures. In particular, HRSG systems may include superheaters through which steam may be superheated before being used by a steam turbine. If the outlet steam from the superheaters reaches high enough temperatures, the steam turbine, as well as other equipment downstream of the HRSG, may be adversely affected. For instance, high cyclic thermal stress in the steam piping and steam turbine may eventually lead to shortened life cycles. In some cases, due to excessive temperatures, control measures may trip the gas turbine and/or steam turbine. This may result in a loss of power generation that may, in turn, impair plant revenues and operability. Inadequately controlled steam temperatures may also lead to high cyclic thermal stress in the steam piping and steam turbine, affecting their useful life. Conventional control systems have been devised to help monitor and control the temperature of outlet steam from HRSG systems. Unfortunately, these control systems often allow temperatures to overshoot during transient periods where, for instance, inlet temperatures into the superheaters increase rapidly.

Conversely, while trying to control high outlet steam temperatures, there are other potential adverse attemperation control effects. There is a danger of causing the temperature to go too low resulting in subsaturated attempertor fluid flowing through the superheaters, interconnecting piping, or steam turbine. Control stability problems can also use cyclic life of the steam system downstream of the attemperator as well as effect the life of the attemperation system valves, pumps, etc.

In particular, a non-model-based technique commonly used consists of a control structure where an outer loop creates a set point temperature for steam entering the finishing high-pressure superheater based on a difference between a desired and an actual steam temperature exiting the finishing high-pressure superheater. An outer loop proportional-integral-derivative (PID) controller may establish the set point temperature for an inner loop PID controller. The inner loop of the control logic may drive the control valve based on the difference between the actual and set point temperature to suitably reduce the steam temperature before it enters the finishing high-pressure superheater. Unfortunately, this technique may not always work to control steam temperature overshoots during transient changes in the gas turbine output. In addition, this technique may often require a great deal of tuning in order to verify satisfactory operation during all potential transients.

Regarding the overshoot problem with the non-model-based technique, as the temperature of the exhaust gas from the gas turbine increases, the temperature of the steam exiting the finishing high-pressure superheater may not only increase beyond the set point temperature, but may continue to overshoot a maximum allowable temperature even after the temperature of the exhaust gas begins to decrease. This overshoot problem may be due in part to the presence of significant thermal lag caused by the mass of metal used in the finishing high-pressure superheater. Other factors affecting attemperation may include the type and sizing of attemperation valves, operating conditions of the attemperator fluid supply pump, distances between equipment used, other limitations of equipment used, sensor location and accuracy, and so forth. This overshoot problem may also become more acute when the gas turbine exhaust temperature changes rapidly.

The conventional attemperator control logic requires an interactive and long tuning cycle. The model-based predictive technique consists of a cascading control structure where the outer loop (some combination of feedback and feed-forward) creates a set point temperature for steam entering the finishing superheater (FSH) (i.e. at the inlet of FSH) based on the difference between a desired and actual steam temperature exiting the finishing superheater (FSH). The inner loop drives the attemperator valves based on the difference between the actual and set point temperature for the inlet to the FSH to suitably reduce the steam temperature before it enters the FSH. Due to the presence of a cascade control structure the control tuning is not easy as the changes in one controller affect the performance of the other. This necessitates an interactive and long tuning cycle. Due to a competitive market and tight commissioning schedules such a controller can end up being less than optimally tuned, thus adversely affecting the long term performance of the whole system.

Accordingly, there is a need for an improved temperature control system in heat recovery systems which is easily tunable to be stable, and also prevents large temperature overshoots, and prevents the flow of subsaturated attempertor fluid through the steam system downstream of the attemperator.

BRIEF DESCRIPTION

In accordance with an embodiment of the invention, a heat recovery steam generation system is provided. The heat recovery steam generation system includes at least one superheater in a steam path for receiving a steam flow and configured to produce a superheated steam flow. The system also includes an inter-stage attemperator for injecting an attemperation fluid into the steam path. The system further includes a control valve coupled to the inter-stage attemperator. The control valve is configured to control flow of attemperation fluid to the inter stage attemperator. The system also includes a controller coupled to the control valve and the inter-stage attemperator. The controller further includes a feedforward controller and a trimming feedback controller. The feedforward controller is configured to determine a desired amount of flow of the attemperation fluid and the trimming feedback controller is configured to compensate for inaccuracies in the determined amount of flow of the attemperation fluid to determine a net desired amount of flow of attemperation fluid through the control valve into an inlet of the inter-stage attemperator based upon an outlet temperature of steam from the superheater. The controller also determines a control valve demand based upon the flow to valve characteristics. The controller further manipulates the control valve of the inter-stage attemperator, and injects the desired amount of attemeration flow via the inter-stage attemperator to perform attemperation upstream of an inlet into the superheater.

In another embodiment, a method for controlling outlet temperatures of steam from a finishing superheater of a heat recovery steam generation system is provided. The method includes determining a desired amount of flow of an open loop attemperation fluid via a feedforward controller. The method also includes compensating for inaccuracies in the determined amount of flow of the open loop attemperation fluid via a trimming feedback controller to determine a net desired amount of flow of attemperation fluid through a control valve into an inlet of an inter-stage attemperator based upon an outlet temperature of steam from a finishing superheater of a heat recovery steam generation system. The method also includes determining the control valve demand based upon attemperation flow to valve characteristics. The method further includes manipulating the control valve of the inter-stage attemperator and injecting the desired attemperation amount to perform attemperation upstream of an inlet into the finishing superheater.

In accordance with an embodiment of the invention, a controller is provided. The controller is coupled to the control valve and the inter-stage attemperator. The controller further includes a feedforward controller and a trimming feedback controller. The feedforward controller is configured to determine a desired amount of flow of the attemperation fluid and the trimming feedback controller is configured to compensate for inaccuracies in the determined amount of flow of the attemperation fluid to determine a net desired amount of flow of attemperation fluid through the control valve into an inlet of the inter-stage attemperator based upon an outlet temperature of steam from the superheater. The controller also determines a control valve demand based upon the flow to valve characteristics. The controller further manipulates the control valve of the inter-stage attemperator, and injects the desired amount of attemeration flow via the inter-stage attemperator to perform attemperation upstream of an inlet into the superheater.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

The present techniques are generally directed to a control system and method for controlling operation of an inter-stage attemperation system upstream of the finishing superheater, further controlling the outlet temperature from the finishing superheater. The control system includes a feed-forward and a feedback control and employs valve characteristics calculation for converting attemperating flow to valve demand for controlling temperature. In particular, embodiments of the control system may determine if attemperation is desired based on whether the outlet temperature of steam from the finishing superheater exceeds a set point temperature as well as whether the inlet temperature of steam into the finishing superheater approaches or is less than the saturation temperature of steam.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Any examples of operating parameters are not exclusive of other parameters of the disclosed embodiments.

Figure 1:
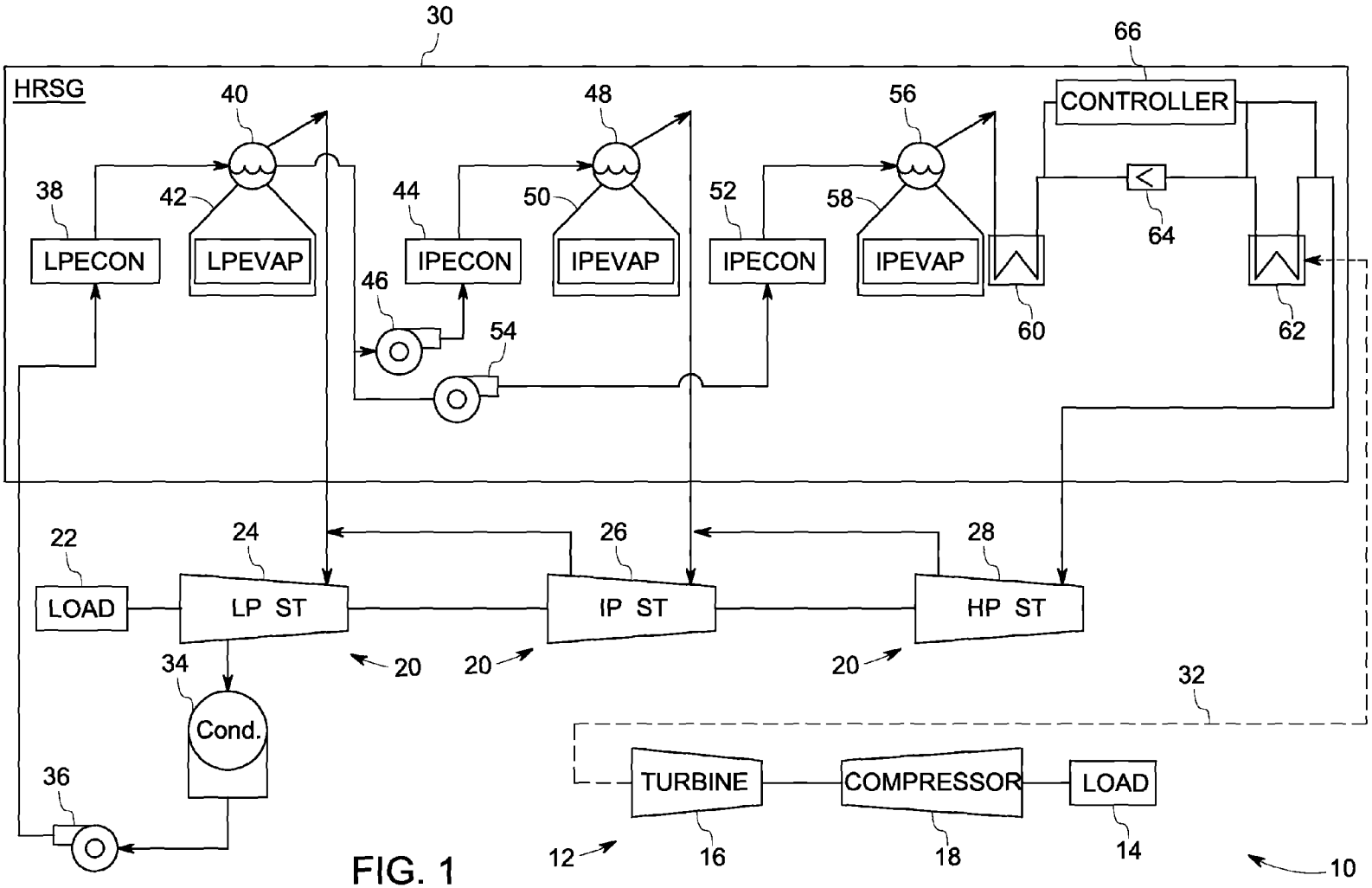
FIG. 1 is a schematic flow diagram of an embodiment of a combined cycle power generation system having a single loop attemperation control.

FIG. 1 is a schematic flow diagram of an exemplary embodiment of a combined cycle power generation system 10 having a temperature control system, as discussed in detail below. The system 10 may include a gas turbine 12 for driving a first load 14. The gas turbine 12 may include a turbine 16 and a compressor 18. The system 10 may also include a steam turbine 20 for driving a second load 22. The first load 14 and the second load 22 may be an electrical generator for generating electrical power or may be other types of loads capable of being driven by the gas turbine 12 and steam turbine 20. In addition, the gas turbine 12 and steam turbine 20 may also be utilized in tandem to drive a single load via a single shaft. In the illustrated embodiment, the steam turbine 20 may include a low-pressure stage 24, an intermediate-pressure stage 26, and a high-pressure stage 28. However, the specific configuration of the steam turbine 20, as well as the gas turbine 12, may be implementation-specific and may include any combination of stages.

The combined cycle power generation system 10 may also include a multi-stage heat recovery steam generator (HRSG) 30. The illustrated HRSG system 30 is a simplified depiction of a general operation of a HRSG system and is not intended to be limiting. Exhaust gases 32 from the gas turbine 12 may be used to heat steam in HRSG 30. Exhaust from the low-pressure stage 24 of the steam turbine 20 may be directed into a condenser 34. Condensate from the condenser 34 may, in turn, be directed into a low-pressure section of the HRSG 30 with the aid of a condensate pump 36. The condensate may flow first through a low-pressure economizer 38 (LPECON), which LPECON 38 may be used to heat the condensate and then may be directed into a low-pressure drum 40. The condensate may be drawn into a low-pressure evaporator 42 (LPEVAP) from the low-pressure drum 40, which LPEVAP 42 may return steam to the low-pressure drum 40. The steam from the low-pressure drum 40 may be sent to the low-pressure stage 24 of the steam turbine 20. Condensate from the low-pressure drum 40 may be pumped into an intermediate-pressure economizer 44 (IPECON) by an intermediate-pressure boiler feed pump 46 and then may be directed into an intermediate-pressure drum 48. The condensate may be drawn into an intermediate-pressure evaporator 50 (IPEVAP) from the intermediate-pressure drum 48, which IPEVAP 50 may return steam to the intermediate-pressure drum 48. The steam from the intermediate-pressure drum 48 may be sent to the intermediate-pressure stage 26 of the steam turbine 20. Condensate from the low-pressure drum 40 may also be pumped into a high-pressure economizer 52 (HPECON) by a high-pressure boiler feed pump 54 and then may be directed into a high-pressure drum 56. The condensate may be drawn into a high-pressure evaporator 58 (HPEVAP) from the high-pressure drum 56, which HPEVAP 58 may return steam to the high-pressure drum 56.

Finally, steam exiting the high-pressure drum 56 may be directed into a primary high-pressure superheater 60 and a finishing high-pressure superheater 62, where the steam is superheated and eventually sent to the high-pressure stage 28 of the steam turbine 20. Exhaust from the high-pressure stage 28 of the steam turbine 20 may, in turn, be directed into the intermediate-pressure stage 26 of the steam turbine 20, and exhaust from the intermediate-pressure stage 26 of the steam turbine may be directed into the low-pressure stage 24 of the steam turbine 20. In certain embodiments, a primary and secondary re-heater may also be used with the primary high-pressure superheater 60 and the finishing high-pressure superheater 62. Again, the connections between the economizers, evaporators, and the steam turbine may vary across implementations as the illustrated embodiment is merely illustrative of the general operation of an HRSG system.

Figure 2:
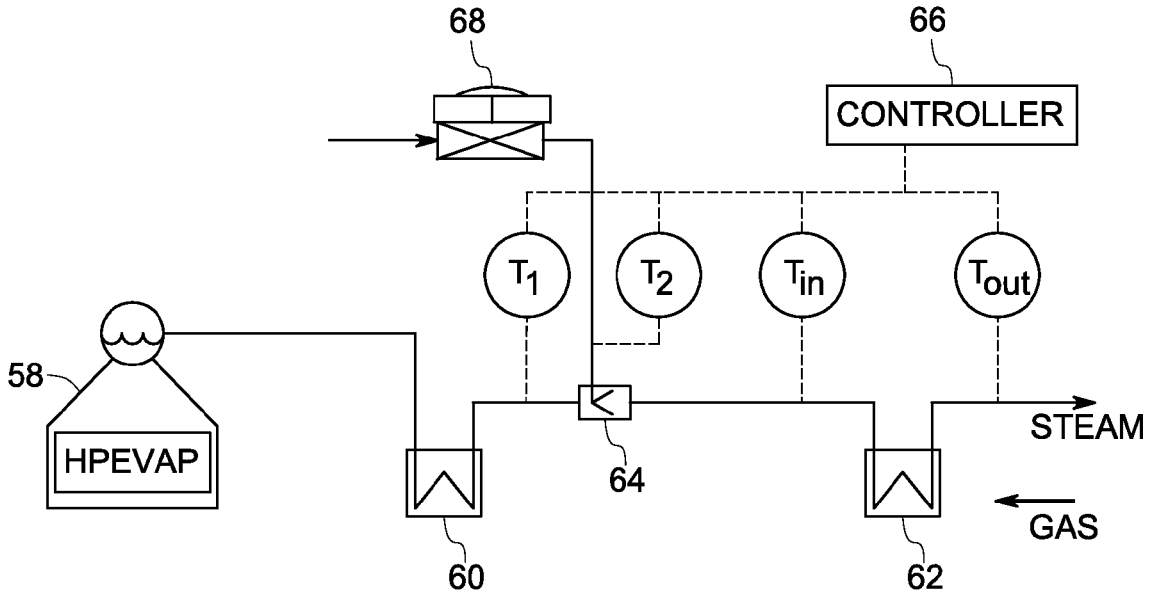
FIG. 2 is a schematic flow diagram of an embodiment of an inter-stage attemperation system using feedwater attemperation along with a simple loop attemperation controller of the system of FIG. 1.

To maintain the efficiency of the processes of HRSG systems and the life of the steam turbine 20 including the associated equipment, a superheater and re-heater inter-stage attemperation may be used to achieve robust temperature control of the steam leaving the HRSG 30. An inter-stage attemperator 64 may be located in between the primary high-pressure superheater 60 and the finishing high-pressure superheater 62. The inter-stage attemperator 64 enables more robust control of the outlet temperature of steam from the finishing high-pressure superheater 62. The inter-stage attemperator 64 may be controlled by a simple loop attemperation control for more precisely controlling the steam outlet temperature from the finishing high-pressure superheater 62. The inter-stage attemperator 64 may, for instance, control the temperature of steam by enabling cooler, high-pressure feedwater, such as a feedwater spray into a steam path when appropriate. Again, although not illustrated in FIG. 1, a primary and/or secondary re-heater may also either be associated with dedicated attemperation equipment or utilize the inter-stage attemperator 64 for attemperation of outlet steam temperatures from the re-heater FIG. 2 is a schematic flow diagram of an embodiment of an inter stage attemperation system using attemperation fluid along with a single loop inter-stage attemperation controller 66 of the system 10 of FIG. 1. The attemperation fluid is at a lower temperature than the inlet temperature of the steam into the superheater. In one embodiment, the inter-stage attemperator 64 may receive the attemperation fluid from a steam process—piping source independent of the heat recovery steam generation system. In another embodiment, the inter-stage attemperator 64 may receive the attemperation fluid from an evaporator or a drum. The controller 66 is coupled to a control valve 68 and the inter-stage attemperator 64 and is configured to determine a net desired amount of flow of attemperation fluid including water or steam through the control valve 68 into an inlet of the inter-stage attemperator 64 based upon an outlet temperature of steam from the finishing superheater 62. The control valve 68 may be any appropriate type of valve. However, no matter what type of valve is used, operation of the control valve 68 may be influenced by a controller 66. The controller 66 further determines a control valve demand based upon flow to valve characteristics and injects the desired amount of flow of attemperation fluid via the inter-stage attemperator 64 to perform attemperation upstream of an inlet into the finishing superheater 62. In one embodiment, the present invention includes a valve management technique which dynamically calculates data that represent control valve demand or flow as a function of a valve lift of a control valve while compensating for pressure variation, density and a corrected flow based on feed forward and feed back, and saturation limitations.

As illustrated in FIG. 2, various inputs into the inter-stage attemperator controller 66 may, for instance, include steam temperature $T_{in}$ at inlet of finishing high-pressure superheater 62, the temperature $T_{out}$ of steam exiting the finishing high-pressure superheater 62, steam temperature at attemperator inlet T1 and attemperator water temperature T2 in one embodiment of the present invention. In another embodiment, other inputs into the inter-stage attemperator controller 66 may include geometric or configuration parameters such as number of superheater tubes, length of the superheater tubes, tube diameter and gas turbine exhaust heat transfer area. In yet another embodiment, further input parameters into the controller 66 may include exhaust gas flow, attemperator inlet pressure, attemperator water flow, steam flow to finishing superheater 62, steam pressure at inlet of finishing high-pressure superheater 62.

Figure 3:
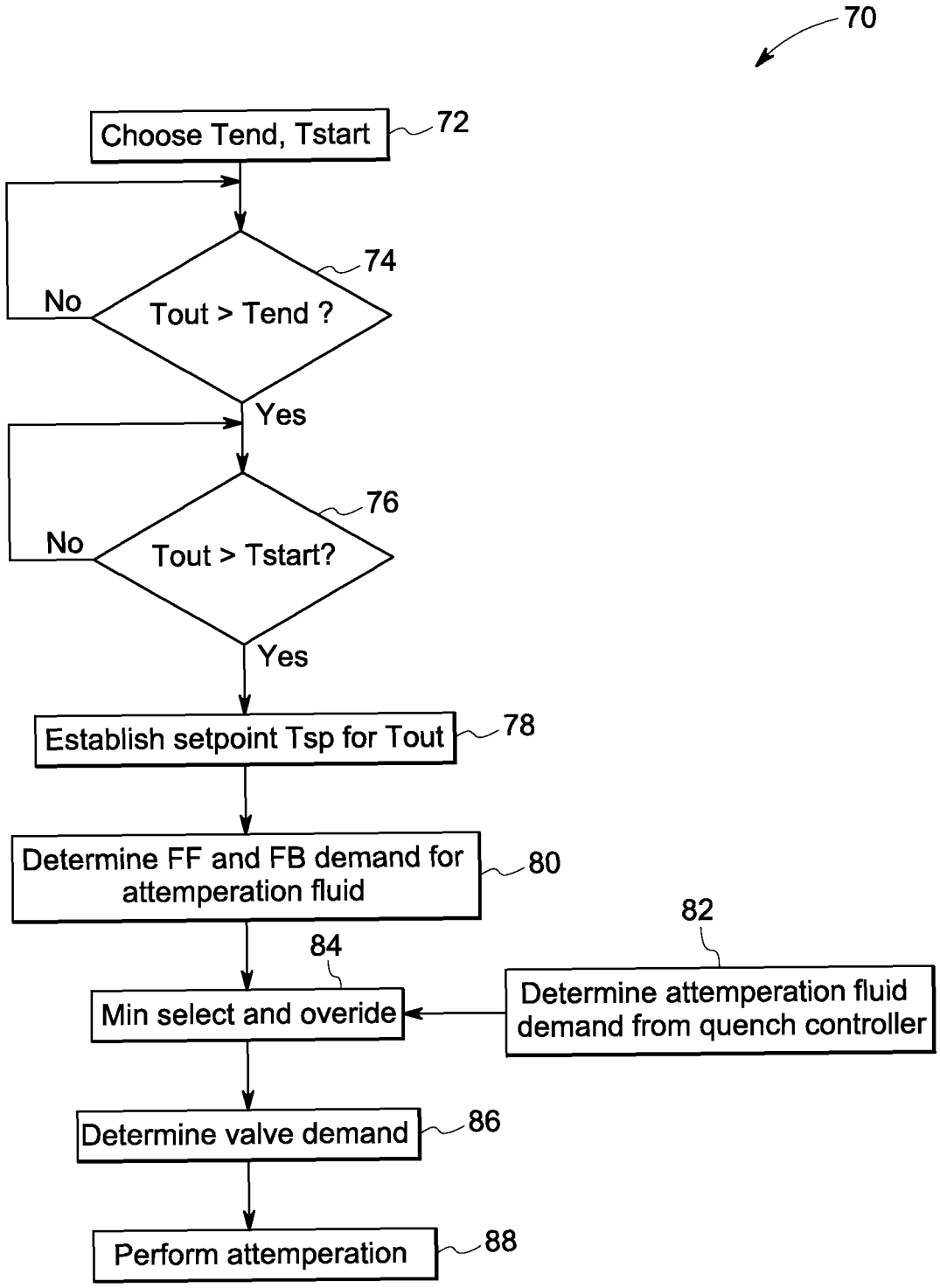
FIG. 3 is a flow diagram of a method for controlling outlet steam temperatures from a superheater in the system of FIG. 1.

FIG. 3 is a flow diagram of a method 70 for controlling outlet steam temperatures from a superheater in the system 10 of FIG. 1. In a non-limiting exemplary embodiment, the method 70 may also be applied to many different types of processes where the outlet temperature of a fluid from a heat transfer device may be controlled. At step 72, a starting superheater temperature $T_{start}$ and stopping superheater temperature $T_{end}$ may be determined for the system 10. The starting superheater temperature $T_{start}$ or the stopping superheater temperature $T_{end}$ should be lower than the desired outlet temperature of the finishing superheater 62. At step 74, if the temperature of the finishing superheater 62 reaches the temperature $T_{end}$ or below then the attemperation process may be stopped. At step 76, attemperation may be triggered only if the temperature of the finishing superheater 62 reaches a temperature equal to or greater than the temperature $T_{start}$. Further at step 78, a set point temperature $T_{sp}$ may be set for the outlet temperature $T_{out}$ of steam from the finishing superheater 62. The set point temperature $T_{sp}$ may be set to any particular temperature, which may protect the steam turbine 20 and associated piping, valving, and other equipment. In other embodiments, the set point temperature $T_{sp}$ may represent a percentage or offset value of the maximum allowable temperature. A suitable value for the set point temperature $T_{sp}$ may, for instance, be 1050° F. At step 80, a net desired amount of attemperation fluid flow $W_T$ is determined based on attemperator flow demand $W_{FF}$ and $W_{PI}$, which in turn are based on feedforward and feedback.

At step 82, an anti-quench attemperator fluid flow $W_Q$ may be determined based on whether the inlet temperature $T_{in}$ as shown in FIG. 2 into the finishing superheater 62 is greater than the saturation temperature $T_{sat}$ of steam plus some predetermined safety value Δ. This step may be desirable to ensure that the steam stays well above the saturation temperature $T_{sat}$ of steam. This determination may be made using steam tables and the inlet pressure $P_{in}$ of the steam. If the inlet temperature $T_{in}$ of steam is greater than $T_{sat}+\Delta$, then attemperation may be warranted. However, if the inlet temperature $T_{in}$ of steam is already currently less than $T_{sat}+\Delta$, then attemperation may be bypassed and the method 70 may proceed back to re-evaluate the situation for a subsequent time period. This control step is essentially an override of the spray attemperation to prevent water impingement on the tubes of the finishing high-pressure superheater 62, which would result in higher than normal stresses or corrosion in the tubes.

Therefore, even if it is determined in step 76 that attemperation may be desirable in order to keep the outlet temperature $T_{out}$ of steam under the set point temperature $T_{sp}$, attemperation may be bypassed in order to maintain the steam temperature sufficiently above the saturation point. In other words, the outlet temperature $T_{out}$ of steam may be allowed to temporarily rise above the set point temperature $T_{sp}$. At step 84, it is determined whether the anti-quench attemperator fluid flow $W_Q$ is desired to be included with the attemperation fluid flow $W_T$.

At step 86, the valve demand is determined based upon the flow demand, valve coefficient, density and change in pressure in the inlet of the inter-stage attemperator and at inlet of the finishing superheater. The control valve demand may be defined as a flow which is a function of the valve lift of a control valve while compensating for pressure variation, density, or corrected flow based on feed forward and feed back, and saturation limitations. Finally, at step 88 the process of attemperation may be performed upstream of the inlet into the finishing high-pressure superheater 62 in order to reduce the inlet temperature $T_{in}$ of steam such that the outlet temperature $T_{out}$ can be maintained to desired level. As discussed above with respect to FIG. 2, the attemperation may involve opening the control valve 68 to allow cooled, high-pressure feedwater spray to be introduced into the steam flow. The spray may act to cool the steam flow such that the inlet temperature $T_{in}$ as shown in FIG. 2 into the finishing high-pressure superheater 62 may be reduced.

Figure 4:
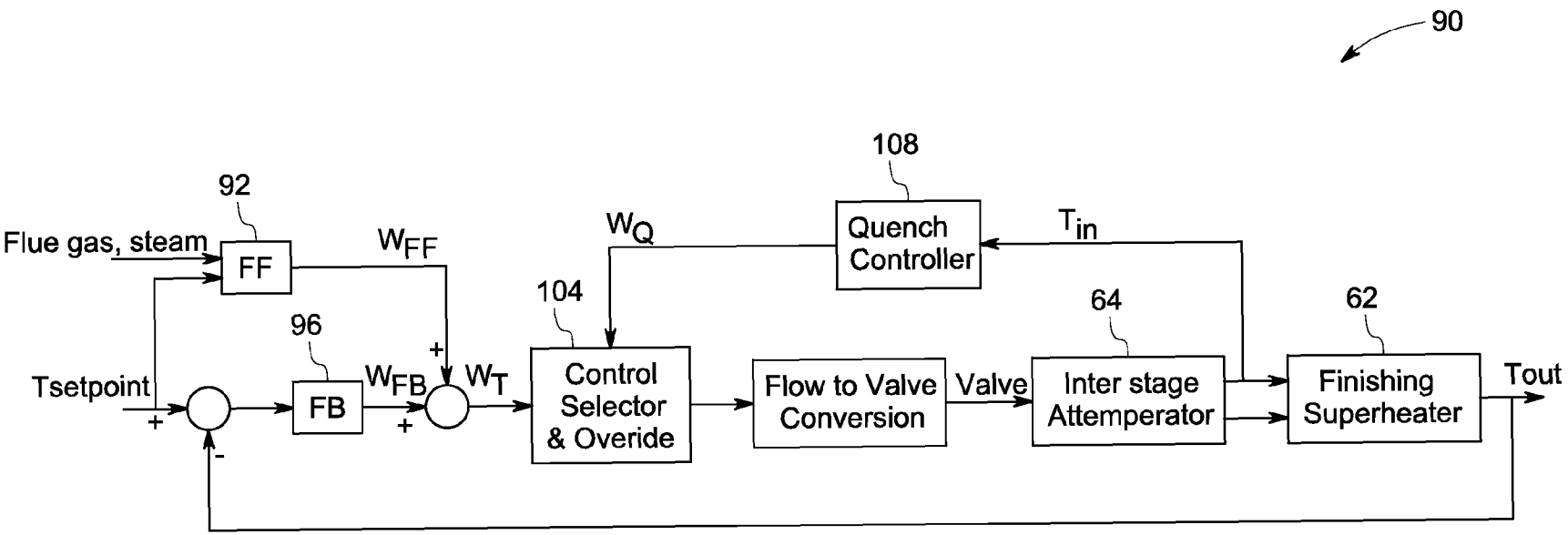
FIG. 4 is another embodiment of a controller structure having a single loop attemperation controller and anti-quench controller.

FIG. 4 is an embodiment of a controller structure 90 having a single loop attemperation control. This controller structure 90 including a feed-forward controller 92 in the single loop is configured to determine a desired amount of flow of feedwater through the control valve 68 as shown in FIG. 2 into an inlet of the inter-stage attemperator 64 based upon an outlet temperature of steam from the finishing superheater 62 using the feed forward control 92. The single loop attemperation control may determine control valve demand based upon flow to valve characteristics and inject a desired amount of feedwater via the attemperator 64 to perform attemperation upstream of the inlet into the finishing superheater 62. The disclosed embodiments of the simple loop attemperation control comprise a feed-forward controller 92 in parallel with a proportional-integral (PI) trimming feedback controller 96 to determine a corrected flow demand $W_T$ based on summation of feed forward flow demand $W_{FF}$ and feed back flow demand $W_{FB}$. As illustrated, the feed-forward controller 92 may use the value for the predicted outlet temperature $T_{out}$ of steam after the value has been determined taking into account, among other things, steam temperature at attemperator inlet, attemperator inlet pressure, attemperator water flow, attemperator water temperature, steam flow to finishing superheater 62, steam temperature $T_{in}$ at inlet of finishing high-pressure superheater 62, steam pressure at inlet of finishing high-pressure superheater 62 and the temperature $T_{out}$ of steam exiting the finishing high-pressure superheater 62. Further input variables into the feed-forward controller 92 may include the geometric or configuration parameters such as number of superheater tubes, length of the superheater tubes and tube diameter.

In one embodiment, the feed-forward value may be determined using model-based predictive techniques, such as, but not limited to, a steady state first principle thermodynamic model. Thus, the controller may be a model-based predictive temperature control logic including an empirical data-based model, a thermodynamic-based model, or a combination thereof. This model-based predictive temperature control may further comprise a proportional-integral controller configured to compensate for inaccuracies in a predictive temperature model. In another embodiment, the feed-forward value may be determined using a physical model such as a first principle physics model. In yet another embodiment, the feed-forward value may be determined using a model based on table look-up or regression based input-output map. The PI trimming feedback controller 96 used in parallel with the feed-forward controller 92 has parallel control paths forming a single loop. However, the exact control elements and control paths may vary among implementations as the illustrated control elements and paths are merely intended to be illustrative of the disclosed embodiments.

Further, the corrected flow demand $W_T$ signal is received by a control selector and an override controller 104. As discussed above with respect to FIG. 3, if the inlet temperature $T_{in}$ of steam is greater than $T_{sat}+\Delta$, then attemperation can proceed which causes a flow demand signal $W_Q$ into the control selector and override controller 104. From a control standpoint, the decision between proceeding with attemperation because the predicted outlet temperature $T_{out}$ of steam is greater than the set point temperature $T_{sp}$ and not proceeding because the inlet temperature $T_{in}$ of steam is not greater than $T_{sat}+\Delta$ may be implemented using another PI quench controller 108 in an anti-quench loop connected to the control selector and an override controller 104 of the main simple attemperation control loop. This anti-quench loop is not integrated into the main loop, therefore is tunable separately without interfering with the tuning of the main loop. Thus, the advantage associated to the main loop in terms of tuning timing remains.

In one embodiment, the control selector and override control 104 may take control of an output from one loop to allow a more important loop to manipulate the output. The override controller 104 not only selects signals from multiple signals being received by it from multiple controllers but also reverts to signal the PI quench controller 108 to stop integrating or winding up. Therefore, the control selector and override controller 104 avoids the wind up problem associated to the PID controls. If the inlet temperature $T_{in}$ is already below $T_{sat}+\Delta$, the adjusted attemperator water flow may be overridden by the control selector and override controller 104. Thus, the controller structure 90 is configured to bypass attemperation whenever an inlet temperature of steam into the finishing superheater 62 does not exceed a saturation temperature of steam by a pre-determined safety value. The saturation temperature $T_{sat}$ of steam into the finishing high-pressure superheater 62 may be calculated based upon, among other things, the inlet pressure $P_{in}$ of steam flowing into the finishing high-pressure superheater 62. This calculation may be made based on some function of pressure, for instance, via steam tables. Once the saturation temperature $T_{sat}$ of steam into the finishing high-pressure superheater 62 is calculated, this value plus some safety value $\Delta$ may be used by the anti-quench controller 108 to determine the flow signal $W_Q$ to the control selector and an override controller 104.

Furthermore, valve demand may be determined based on the flow demand and valve characteristics which in turn is based upon valve coefficient, density and change in pressure across the attemperator valve, thereby operating the control valve 68 to either increase or decrease the amount of attemperation at the inter-stage attemperator 64, which in turn, may affect the inlet temperature $T_{in}$ of steam at the inlet of the finishing high-pressure superheater 62. In one embodiment, the control valve 68 may be accompanied with a linearization function block to make the loop gain generally constant. This approach may allow for simplified tuning (e.g., requiring tuning only at one load) and consistent loop response over the load range. Linearization of the control valve 68 responses in this manner may also prove particularly useful when operating a large plant with heavy load variation where the loop gain changes significantly across the load range.

Advantageously, the present invention uses a simple loop structure with a feed forward controller to give a flow, which is then converted to the precise valve demand for attemperation using the valve characteristics. Thus, the thermal lag associated with the additional PI controller of inner loop as used in the present system is done away with. Thereby, the present invention has considerably smaller induced thermal lag. Also, the other advantage is that the tuning parameters are less owing to the simple loop structure in the system. In today's competitive market and tight commissioning schedules such controller normally would be more preferred as it can be optimally tuned in a shorter time, thus enhancing the performance of the whole system.

Moreover, while the disclosed embodiments may be specifically suited for inter-stage attemperation of steam, they may also be used in other similar applications such as food and liquor processing plants. Further, the concept of using a single controller instead of a cascade controller is applicable at almost all places where the inner loop is very fast compared to the outer loop and the control variable associated with the inner loop is not required to be regulated or tracked to some desired value.

As discussed above, the disclosed embodiments may be utilized in many other scenarios other than the control of outlet steam temperatures. For instance, the disclosed embodiments may be used in virtually any system where a fluid is to be heated, or cooled for that matter, using a heat transfer device. Whenever it may be important to control the outlet temperature of the fluid from the heat transfer device, the disclosed embodiments may utilize model-based predictive techniques to predict the outlet temperature based on inlet conditions into the heat transfer device. Then, using the predicted outlet temperature with the disclosed embodiments, attemperation of the inlet temperature into the heat transfer device may be performed to ensure that the actual outlet temperature from the heat transfer device stays within an acceptable range (e.g., below a set point temperature or above a saturation temperature). Furthermore, control of the model-based prediction and attemperation process may be performed using the techniques as described above. Therefore, the disclosed embodiments may be applied to a wide range of applications where fluids may be heated or cooled by heat transfer devices.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A heat recovery steam generation system, comprising:

at least one superheater in a steam path for receiving a steam flow and configured to produce a superheated steam flow;

an inter-stage attemperator for injecting an attemperation fluid into the steam path;

a control valve coupled to the inter-stage attemperator, the control valve configured to control flow of the attemperation fluid to the inter stage attemperator; and a controller comprising a feedforward controller configured to determine a desired amount of flow of the open loop attemperation fluid and a trimming feedback controller configured to compensate for inaccuracies in the determined amount of flow of the open loop attemperation fluid to determine a net desired amount of flow of attemperation fluid through the control valve into an inlet of the inter-stage attemperator based upon an outlet temperature of steam from the superheater; wherein the controller is further configured to:

determine a control valve demand based upon flow to valve characteristics;

manipulate the control valve of the inter-stage attemperator, and inject the desired amount of flow via the inter-stage attemperator to perform attemperation upstream of an inlet into the superheater.

2. The heat recovery steam generation system of claim 1, wherein an evaporator in the steam path may be configured to deliver steam to the superheater.

3. The heat recovery steam generation system of claim 1, wherein a steam boiler drum in the steam path may be configured to deliver steam to the superheater.

4. The heat recovery steam generation system of claim 1, wherein the system may comprise a reheater in a steam path and configured to reheat the steam.

5. The heat recovery steam generation system of claim 1, wherein the superheater further comprises a primary superheater and a finishing superheater, both in the steam path and configured to superheat steam from the evaporator.

6. The heat recovery steam generation system of claim 5, wherein the inter-stage attemperator is in the steam path downstream of the primary superheater and upstream of the finishing superheater and configured to inject attemperation fluid into the steam path.

7. The heat recovery steam generation system of claim 1, wherein the control valve demand is determined based upon the flow demand, valve coefficient, density and change in pressure across the control valve.

8. The heat recovery steam generation system of claim 1, further comprising an anti-quench controller configured to maintain steam temperature at inlet of the superheater above a saturation temperature.

9. The heat recovery steam generation system of claim 8, wherein the anti-quench controller is decoupled from the controller.

10. A method for controlling outlet temperatures of steam from a finishing superheater of a heat recovery steam generation system, comprising:

determining a desired amount of flow of an open loop attemperation fluid via a feedforward controller;

compensating for inaccuracies in the determined amount of flow of the open loop attemperation fluid via a trimming feedback controller;

determining a net desired amount of flow of attemperation fluid through a control valve into an inlet of an inter-stage attemperator based upon an outlet temperature of steam from a finishing superheater of a heat recovery steam generation system;

determining a control valve demand based upon flow to valve characteristics; manipulating the control valve of the inter-stage attemperator; and injecting the desired amount of flow of attemperation fluid to perform attemperation upstream of an inlet into the finishing superheater.

11. The method of claim 10, comprising determining inlet variables at the inlet into the finishing superheater, wherein a model-based predictive temperature control is configured to predict the outlet temperature of the steam based on the inlet variables.

12. The method of claim 10, wherein performing attemperation comprises opening a control valve upstream of the inlet into the finishing superheater, wherein opening the control valve introduces attemperation fluid into a path with the steam, and the attemperation fluid is cooler than the steam.

13. The method of claim 10, wherein attemperation is performed only if the inlet temperature of the steam into the finishing superheater is greater than a saturation temperature of steam by a pre-determined safety value.

14. A controller comprising a feedforward controller configured to determine a desired amount of flow of the open loop attemperation fluid and a trimming feedback controller configured to compensate for inaccuracies in the determined amount of flow of the open loop attemperation fluid to determine a net desired amount of flow of attemperation fluid through the control valve into an inlet of the inter-stage attemperator based upon an outlet temperature of steam from the superheater; wherein the controller is further configured to:

determine a control valve demand based upon flow to valve characteristics;

manipulate the control valve of the inter-stage attemperator, and inject the desired amount of flow via the inter-stage attemperator to perform attemperation upstream of an inlet into the superheater.

15. The controller of claim 14, wherein the controller is configured to bypass attemperation whenever an inlet temperature of steam into the superheater does not exceed a saturation temperature of steam by a pre-determined safety value.

16. The controller of claim 14, wherein the controller is at least partially based on input variables comprising an inlet temperature of a flue gas into the superheater, an inlet pressure of steam or flue gas into the superheater, an inlet flow rate of steam or flue gas into the superheater, valve coefficient, density, inlet attemperator pressure, inlet attemperator temperature or a combination thereof.

17. The controller of claim 14, wherein the controller has a model-based predictive temperature control logic comprising an empirical data-based model, a thermodynamic-based model, or a combination thereof.

18. The controller of claim 17, wherein the model-based predictive temperature control logic comprises a proportional-integral controller configured to compensate for inaccuracies in a predictive temperature model.

19. The controller of claim 14, wherein the control loop comprises a linearization function block for operation of the control valve.

20. The controller of claim 14, wherein the control valve demand is determined based upon the flow demand, valve coefficient, density and change in pressure across the control valve.

* * * * *

UNITED STATES PATENT AND TRADEMARK OFFICE

CERTIFICATE OF CORRECTION

PATENT NO. : 8,733,104 B2
APPLICATION NO. : 12/408741
DATED : May 27, 2014
INVENTOR(S) : Kumar et al.

It is certified that error appears in the above-identified patent and that said Letters Patent is hereby corrected as shown below:

On the Title Page, in the Figure, delete "

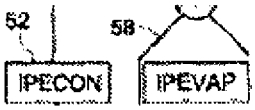

" and insert

-- 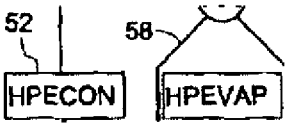

--, therefor.

In the Drawings

In Fig. 1, Sheet 1 of 4, delete "

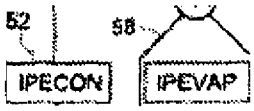

" and insert --

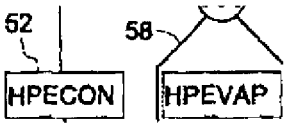

--, therefor.

In the Specification

In Column 2, Lines 56-57, delete "attemeration" and insert -- attemperation --, therefor.

In Column 3, Line 25, delete "attemeration" and insert -- attemperation --, therefor.

Signed and Sealed this
Twenty-third Day of September, 2014

Michelle K. Lee

Michelle K. Lee
*Deputy Director of the United States Patent and Trademark Office*